US007230576B2

(12) United States Patent
Liao et al.

(10) Patent No.: US 7,230,576 B2
(45) Date of Patent: Jun. 12, 2007

(54) ELECTRONIC DEVICE

(75) Inventors: Kuo-Ju Liao, Erlun Township, Yunlin County (TW); Tso-San Yang, Banciao (TW)

(73) Assignee: Benq Corporation, Taoyuan Shien (TW)

( * ) Notice: Subject to any disclaimer, the term of this patent is extended or adjusted under 35 U.S.C. 154(b) by 13 days.

(21) Appl. No.: 11/220,840

(22) Filed: Sep. 7, 2005

(65) Prior Publication Data

US 2006/0049998 A1 Mar. 9, 2006

(30) Foreign Application Priority Data

Sep. 7, 2004 (TW) ..... 93127073 A

(51) Int. Cl.
*H01Q 1/24* (2006.01)

(52) U.S. Cl. ..... 343/702; 343/700 MS

(58) Field of Classification Search ..... 343/702, 343/700 MS, 829, 846
See application file for complete search history.

(56) References Cited

U.S. PATENT DOCUMENTS

2006/0038733 A1* 2/2006 Wedel et al. ..... 343/795
2006/0234657 A1* 10/2006 Boyle ..... 455/129

* cited by examiner

*Primary Examiner*—Tho Phan
(74) *Attorney, Agent, or Firm*—Thomas, Kayden, Horstemeyer & Risley

(57) ABSTRACT

An electronic device includes a circuit board, a dual band planar inverted-F antenna, and a loud speaker. The circuit board has a ground terminal and a feeding terminal. The dual band planar inverted-F antenna includes a short circuit part, a feeding part, and a radiator. The short circuit part is connected to the ground terminal. The feeding part is connected to the feeding terminal. The radiator with an opening is connected to the ground terminal and the feeding terminal through the short circuit part and the feeding part, respectively. The loud speaker is connected to the circuit board for playing voice. The loud speaker is disposed substantially under the opening.

21 Claims, 3 Drawing Sheets

ELECTRONIC DEVICE

This application claims the benefit of Taiwan application Serial No. 93127073, filed Sep. 7, 2004, the subject matter of which is incorporated herein by reference.

BACKGROUND OF THE INVENTION

1. Field of the Invention

The invention relates to an electronic device, and more particularly to an electronic device capable of reducing radiation signal interference.

2. Description of the Related Art

As regards the development trend of the integrated circuit, miniaturization and compact design are inevitable trends in this modern life as well as in the future. The wireless electronic products, mobile phones for example, are also in this trend. The space for each component within the mobile phone is therefore reduced.

The mobile phone transmits radiation signals via antenna. In general, the mobile phone with hidden antenna uses the Planar Inverted-F Antenna (PIFA) for signal transmission. The operational length of the PIFA is half of the general antenna's operational length so as to reduce the area occupied by the antenna significantly. In addition, the PIFA is characterized by its low position, and consequently, the objective of concealing the antenna is achieved. Therefore, the PIFA has already been widely applied to various kinds of mobile phones with hidden antenna so as to achieve the objective of reducing the size of the mobile phones.

Referring to FIG. 1, a top view of part of the components of the conventional mobile phone with hidden antenna is shown. The mobile phone 100 includes the PIFA 120, the circuit board 110 and the loud speaker 130. The PIFA 120 is used to transmit radiation signals. The circuit board 110 and the PIFA 120 are separated by a medium material (not shown in the drawings). Air, resilient polystyrene plastic, microwave base and the combination of the foregoing are examples of the medium material. The loud speaker 130 is electrically connected to the circuit board 110 and disposed under the PIFA 120, in order to achieve the goal of saving space.

However, the loud speaker 130 is likely to be interfered by the radiation signals emitted from the PIFA 120 in this configuration. Besides, when the loud speaker 130 is interfered by the radiation signals emitted form the PIFA 120, the radiation signals are very likely to couple with other circuits on the circuit board 110 via the loud speaker 130 resulting in interfering to other circuits. Moreover, when the intensity of the radiation signals imposed on the loud speaker 130 is too strong, the loud speaker 130 even affects the receiving functions of the PIFA 120.

SUMMARY OF THE INVENTION

It is therefore an object of the invention to provide an electronic device to reduce the interference to the loud speaker and other circuits caused by radiation signals and to improve the receiving quality of the antenna.

In accordance with the objectives of the invention, it provides an electronic device. The electronic device includes the circuit board, the dual band Planar Inverted-F Antenna (PIFA) and the loud speaker. The circuit board has a ground terminal and a feeding terminal. The dual band PIFA is operated on the first operational frequency band and the second operational frequency band. The dual band PIFA includes the short circuit part, the feeding part, and the radiator. The short circuit part is electrically connected to the ground terminal. The feeding part is electrically connected to the feeding terminal. The radiator with an opening is connected to the ground terminal and the feeding terminal through the short circuit part and the feeding part, respectively. The loud speaker is connected to the circuit board for playing voice. The loud speaker is disposed corresponding to the opening substantially.

Other objects, features, and advantages of the invention will become apparent from the following detailed description of the preferred but non-limiting embodiments. The following description is made with reference to the accompanying drawings.

DETAILED DESCRIPTION OF THE INVENTION

The pattern of the radiator plays an important role in the Planar Inverted-F Antenna (PIFA), because it determines the operational characteristic of the antenna. By way of redesigning the pattern of the radiators in the PIFA and changing the relative location of the loud speaker and the PIFA in the electronic device, the interference to the loud speaker and other circuits from the radiation signals can be reduced.

Figure 2:
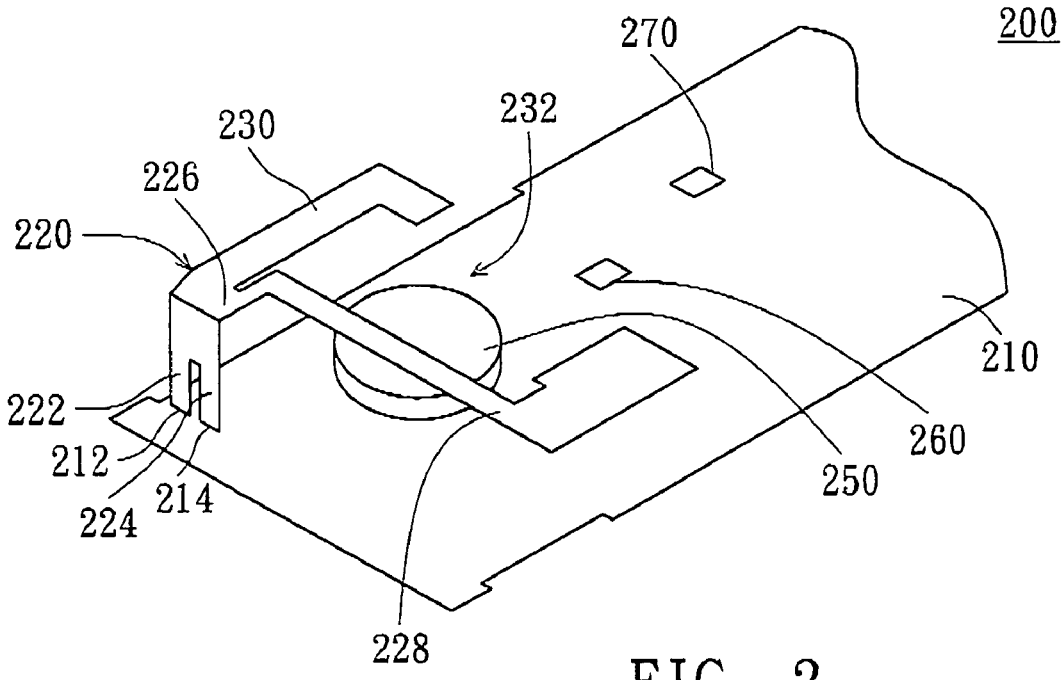
FIG. 2 is a partial view of an electronic device according to a preferred embodiment of the invention.

Referring to FIG. 2 is a partial view of an electronic device according to a preferred embodiment of the invention. The electronic device 200 such as mobile phones includes the circuit board 210, dual band PIFA 220 and loud speaker 250.

The circuit board 210 has the ground terminal 212 and the feeding terminal 214. The loud speaker 250 is electrically connected to the circuit board 210. The dual band PIFA 220 includes the short circuit part 222, the feeding part 224, the radiator 226 and the medium material (not shown in the drawings). The integrated configuration is designed as an example of the short circuit part 222, the feeding part 224 and the radiator 226. The short circuit part 222, such as sheet metal, is electrically connected to the ground terminal 212. The feeding part 224, such as sheet metal, is electrically connected to the feeding terminal 214. The radiator 226 is connected to the ground terminal 212 and the feeding terminal 214 through the short circuit part 222 and the feeding part 224, respectively. The medium material placed between the radiator 226 and the circuit board 210 is used to separate the radiator 226 from the circuit board 210. Air, resilient polystyrene plastic, microwave base and the combination thereof are examples of the medium material.

The radiator 226 includes the long-arm radiation portion 228 and the short-arm radiation portion 230. The long-arm radiation portion 228 is joined to the short-arm radiation portion 230. The opening 232 is formed between the long-arm radiation portion 228 and the short-arm radiation portion 230. The long-arm radiation portion 228 has the first resonance mode in order to make the dual band PIFA being operated on the first operational frequency band. The short-arm radiation portion 230 has the second resonance mode in order to make the dual band PIFA being operated on the second operational frequency band.

Figure 3:
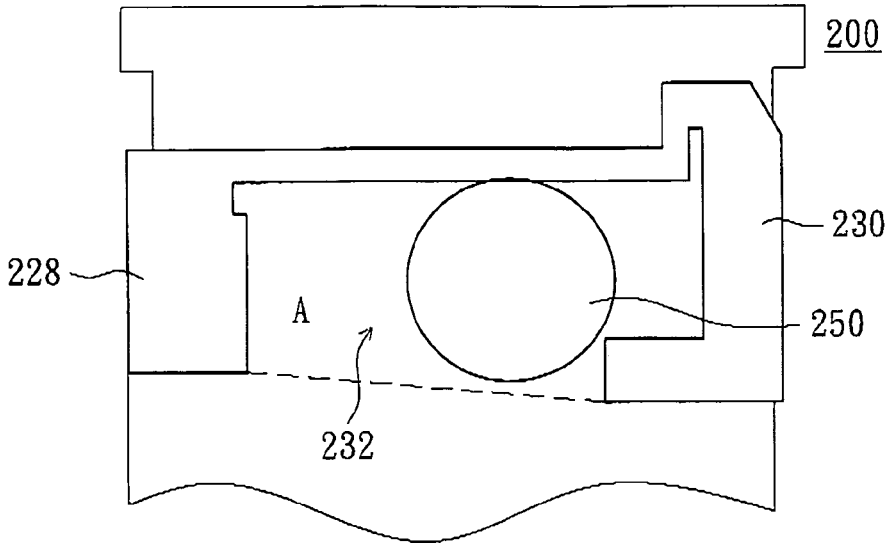
FIG. 3 is a top view illustrating the electronic device in FIG. 2.

Referring to FIG. 3, a top view illustrating the electronic device in FIG. 2 is shown. It is clearly showed in FIG. 3 that the loud speaker 250 is disposed corresponding to the opening 232 substantially, and the area of the loud speaker 250 is smaller than area A of the opening 232 substantially. The area A of the opening 232 is an area enclosed with the long-arm radiation portion 228, the short-arm radiation portion 230, and the dotted line.

Figure 1:
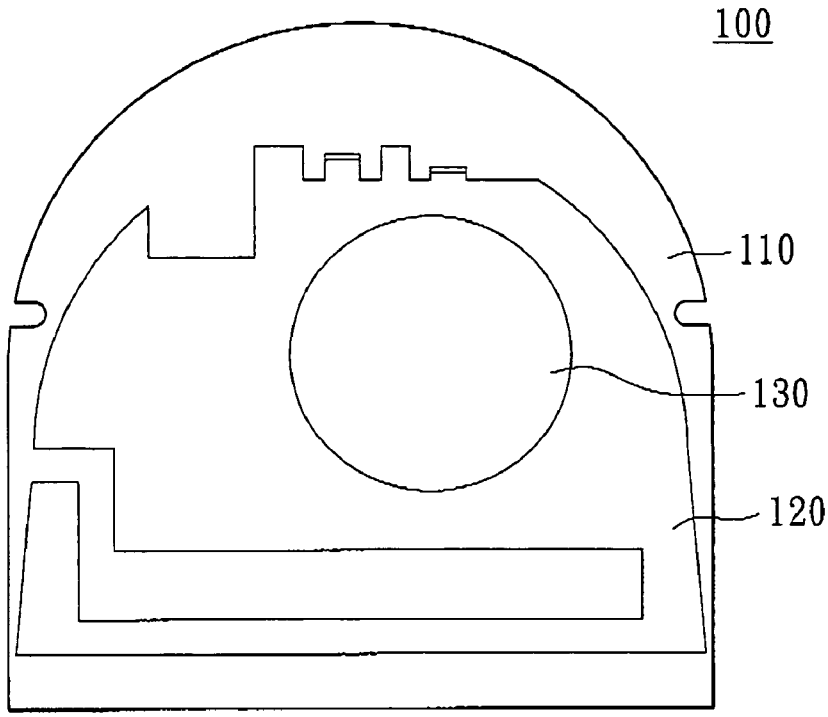
FIG. 1(PRIOR ART)
FIG. 1 is a top view illustrating part of the components inside a conventional mobile phone with a hidden antenna.
Figure 4:
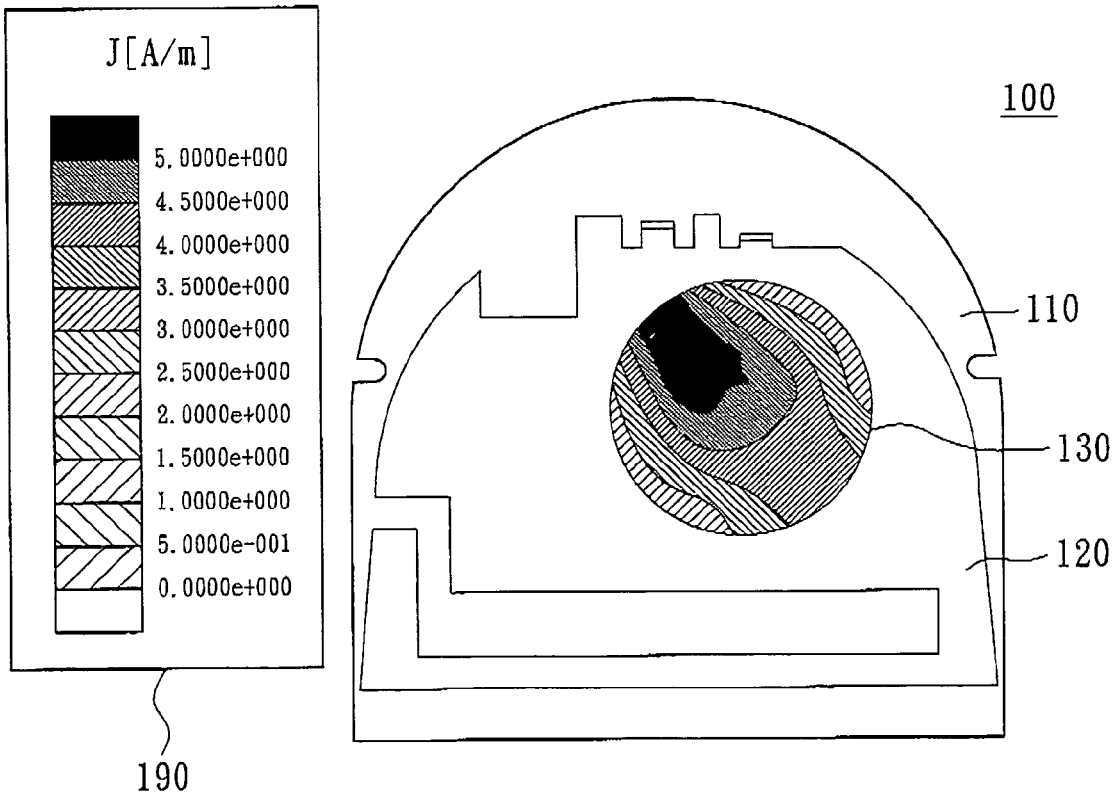
FIG. 4 is a diagram illustrating the current distribution of the PIFA in FIG. 1 coupled with a loud speaker.
Figure 5:
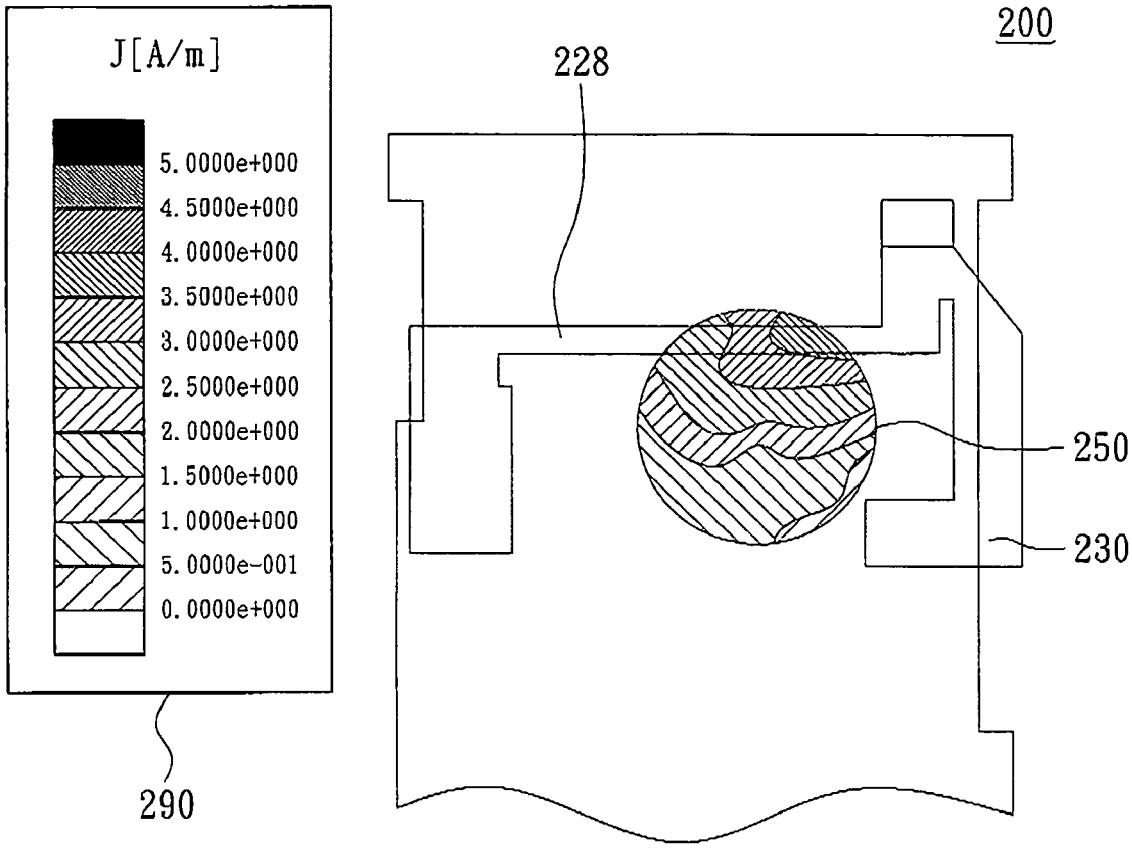
FIG. 5 is a diagram illustrating the current distribution of the PIFA in FIG. 2 coupled with the loud speaker.

Referring to both FIGS. 4 and 5, FIG. 4 is a diagram illustrating the current distribution of the PIFA 120 in FIG. 1 coupled with a loud speaker 130. FIG. 5 is a diagram illustrating the current distribution of the PIFA 220 in FIG. 2 coupled with the loud speaker 250. The density of the inclined lines is used to represent the current intensity of the loud speaker coupled with the PIFA. The denser inclined-line indicates the coupling current is stronger. In FIG. 4, the current distribution of the conventional PIFA 120 coupled with the loud speaker 130 is about 3 J to 5 J while referring to the collating form 190. In FIG. 5, the current distribution of the conventional PIFA 220 coupled with the loud speaker 250 is about 1 J to 3.5 J while referring to the collating form 290. Therefore, the current of the PIFA 220 coupled with the loud speaker 250 is obvious smaller than the current of the PIFA 120 coupled with the loud speaker 130. Accordingly, through designing pattern of the radiator 226 of the dual band PIFA 220, and setting up the relative location between the loud speaker 250 and the dual band PIFA 220, the interference to the loud speaker by the radiation signals can be reduced. The receiving quality of the dual band PIFA can be enhanced accordingly.

Referring to FIG. 2, the electronic device 200 further includes the integrated circuit 260 and 270. The sensitivity of the integrated circuit 260 for the radiation signals is lower than that of integrated circuit 270 for the radiation signals substantially. The integrated circuit 260 and 270 electrically connects to the circuit board 210. The distance between the integrated circuit 270 and the loud speaker 250 is preferably larger than the distance between the integrated circuit 260 and the loud speaker 250. The integrated circuit 270 is disposed in this manner in order to reduce the interference to the integrated circuit 270 by the radiation signals.

In other words, if some other components or integrated circuit is needed to be disposed on the circuit board 210, preferably, the components with higher sensitivity or integrated circuit is disposed far away from the loud speaker 250, the farther the better whenever space permits. Accordingly, when the loud speaker 250 is interfered with the radiation signals, the radiation signals can be prevented from coupling with other components or the integrated circuit via the loud speaker 250.

The foregoing electronic device can reduce the interference to the loud speaker and other circuits caused by radiation signals, thereby enhancing the receiving quality of the dual band PIFA.

While the invention has been described by way of example and in terms of a preferred embodiment, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. An electronic device, comprising:

a circuit board having a ground terminal and a feeding terminal;

a dual-band Planar Inverted-F Antenna (PIFA) being operated in a first operational frequency band and a second operational frequency band, wherein the dual PIFA comprises;

a short circuit part electrically connected with the ground terminal;

a feeding part electrically connected with the feeding terminal; and a radiator having an opening, wherein the radiator connects to the ground terminal and the feeding terminal via the short circuit part and the feeding part, respectively; and a loud speaker electrically connected to the circuit board for playing voice, wherein the loud speaker is disposed corresponding to the opening substantially, wherein an area of the opening is substantially larger than an area of the loud speaker so as to reduce interference to the loud speaker by radiation signals from the radiator.

2. The electronic device according to claim 1, wherein the dual band PIFA further comprises a medium material placed between the radiator and the circuit board for separating the radiator from the circuit board.

3. The electronic device according to claim 2, wherein the medium material comprises air.

4. The electronic device according to claim 1, wherein the short circuit part, the feeding part and the radiator are monolithically formed.

5. The electronic device according to claim 1, wherein the short circuit part is a sheet metal.

6. The electronic device according to claim 1, wherein the feeding part is a sheet metal.

7. The electronic device according to claim 1 being a mobile phone.

8. An electronic device, comprising:

a circuit board having a ground terminal and a feeding terminal;

a dual-band Planar Inverted-F Antenna (PIFA) being operated in a first operational frequency band and a second operational frequency band, wherein the dual PIFA comprises:

a short circuit part electrically connected with the ground terminal;

a feeding part electrically connected with the feeding terminal; and a radiator having an opening, wherein the radiator connects to the ground terminal and the feeding terminal via the short circuit part and the feeding part, respectively, wherein the radiator comprises:

a long-arm radiation portion having a first resonance mode in order to operate the dual band PIFA in the first operational frequency band; and a short-arm radiation portion connected to the long-arm radiation portion, wherein the opening is formed between the long-arm radiation portion and the short-arm radiation portion, and the short-arm radiation portion has a second resonance mode in order to operate the dual band PIFA in the second operational frequency band; and a loud speaker electrically connected to the circuit board for playing voice, wherein the loud speaker is disposed corresponding to the opening substantially.

9. The electronic device according to claim 8, wherein the dual band PIFA further comprises a medium material placed between the radiator and the circuit board for separating the radiator from the circuit board.

10. The electronic device according to claim 9, wherein the medium material comprises air.

11. The electronic device according to claim 8, wherein the short circuit part, the feeding part and the radiator are monolithically formed.

12. The electronic device according to claim 8, wherein the short circuit part is a sheet metal.

13. The electronic device according to claim 8, wherein the feeding part is a sheet metal.

14. The electronic device according to claim 8 being a mobile phone.

15. An electronic device, comprising:

a circuit board having a ground terminal and a feeding terminal;

a dual-band Planar Inverted-F Antenna (PIFA) being operated in a first operational frequency band and a second operational frequency band, wherein the dual PIFA comprises:

a short circuit part electrically connected with the ground terminal;

a feeding part electrically connected with the feeding terminal; and a radiator having an opening, wherein the radiator connects to the ground terminal and the feeding terminal via the short circuit part and the feeding part, respectively;

a loud speaker electrically connected to the circuit board for playing voice, wherein the loud speaker is disposed corresponding to the opening substantially;

a first integrated circuit electrically connected to the circuit board; and a second integrated circuit electrically connected to the circuit board, the first integrated circuit for the radiation signals being more sensitive than the second integrated circuit for radiation signals, a distance between the second integrated circuit and the loud speaker being smaller than a distance between the first integrated circuit and the loud speaker.

16. The electronic device according to claim 15, wherein the dual band PIFA further comprises a medium material placed between the radiator and the circuit board for separating the radiator from the circuit board.

17. The electronic device according to claim 16, wherein the medium material comprises air.

18. The electronic device according to claim 15, wherein the short circuit part, the feeding part and the radiator are monolithically formed.

19. The electronic device according to claim 15, wherein the short circuit part is a sheet metal.

20. The electronic device according to claim 15, wherein the feeding part is a sheet metal.

21. The electronic device according to claim 15 being a mobile phone.

* * * * *